US006846982B2

(12) United States Patent
Sato

(10) Patent No.: US 6,846,982 B2
(45) Date of Patent: Jan. 25, 2005

(54) KEY DEPRESSION DETECTION APPARATUS FOR KEYBOARD INSTRUMENT

(75) Inventor: Shigeaki Sato, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 149 days.

(21) Appl. No.: 10/372,815

(22) Filed: Feb. 26, 2003

(65) Prior Publication Data

US 2003/0202834 A1 Oct. 30, 2003

(30) Foreign Application Priority Data

Mar. 1, 2002 (JP) ..... 2002-056354

(51) Int. Cl.[7] ..... G10H 1/34; G10H 3/00
(52) U.S. Cl. ..... 84/745
(58) Field of Search ..... 84/718–720, 743–745

(56) References Cited

U.S. PATENT DOCUMENTS 5,237,125 A * 8/1993 Fields ..... 84/626
5,546,842 A 8/1996 Pimentel
5,719,347 A * 2/1998 Masubuchi et al. ..... 84/687
6,712,323 B1 * 3/2004 Cheung et al. ..... 248/201

FOREIGN PATENT DOCUMENTS

JP 8-278780 10/1996
JP 8-314461 11/1996

* cited by examiner

*Primary Examiner*—Jeffrey W Donels
(74) *Attorney, Agent, or Firm*—Dickstein, Shapiro, Morin & Oshinsky, LLP.

(57) ABSTRACT

A key depression detection apparatus is constituted by a sensor case incorporating key sensors, which can be easily adjusted in positions relative to an arrangement of keys on a keyboard frame (or a keybed) in a keyboard instrument such as a piano. The sensor case has a case body incorporating a key sensor and is affixed to a base member that is fixed to the keyboard frame by using a fixing member, which is constituted by a lower member and a pair of upper members. The legs of the case body are securely held by the fixing member between the lower member and upper members, which are connected together using screws accompanied with springs. Thus, an operator can easily adjust the sensor case in position relative to an arrangement of keys by manually controlling screws.

7 Claims, 6 Drawing Sheets

KEY DEPRESSION DETECTION APPARATUS FOR KEYBOARD INSTRUMENT

BACKGROUND OF THE INVENTION

1. Field of the Invention

This invention relates to key depression detection apparatuses that detect depressing operations of keys (or key depressions) in keyboard instruments such as acoustic pianos and electronic keyboard instruments.

2. Description of the Related Art

In acoustic pianos, vibrations of strings are transmitted to soundboards to cause sound radiation (or emission). Pianos having silencing functions use sensors for detecting operations of keys and operations of hammers interlocked with keys, based on which musical tone signals are correspondingly produced. Operators (e.g., users and players) may use headphone sets to listen to musical tones corresponding to amplified musical tone signals, so that they can enjoy playing pianos and the like without disturbing their neighborhoods.

Acoustic pianos may include grand pianos, upright pianos, and the like. In the case of a grand piano, for example, three strings are stretched under tension and tuned with respect to each of middle pitch sounds and high pitch sounds, so that the three strings are simultaneously struck by a single hammer upon depression of a key. When an operator depresses a soft pedal, an action (or a keyboard assembly) interlocked with a key is slightly shifted in position in a key arrangement direction (i.e., a horizontal direction or operator's left-hand-right-hand direction), so that a hammer strikes only two strings among three strings to lessen tone volume. The action is supported on a keybed by means of a keyboard frame, which is one type of a key frame for mounting the action interlocked with the key and which performs reciprocating motion being interlocked with the soft pedal in the key arrangement direction. In order to smoothly perform such operation, the aforementioned keyboard frame has a specific structure using a frame member extending in a direction perpendicular to the key arrangement direction.

Grand pianos having silencing functions are equipped with key depression detection apparatuses incorporating photo-interrupters, which operate in cooperation with plate-like key shutters arranged for keys and which are attached to sensor cases fixed to keyboard frames. In this apparatus, upon depression of a key, a key shutter is activated to block light, the magnitude of which may be correspondingly varied and is sensed by a photo-interrupter to detect an operation of the key, thus generating a musical tone signal. The sensor case is used to determine positions of holding sensors; therefore, it should be subjected to specific positioning accurately in correspondence with an arrangement of keys. In an assembling operation of a piano, it takes a relatively long time for work to carefully set positioning with respect to the sensor case. In particular, the position of a sensor case should be strictly restricted by the position of a keyboard frame having the aforementioned structure. Therefore, it is required for workers to use specific tools and to appropriately set different holes for arrangements of different keyboard frames whose dimensions differ from each other.

Silencing structures can be additionally arranged for the existing grand pianos to realize silencing functions thereafter. In this case, it is required for workers to arrange silencing structures in consideration of designs and specifications of pianos respectively; therefore, it may take a relatively long time for work to arrange sensor cases appropriately in the existing pianos.

Upright pianos can be designed to realize silencing functions by using key depression detection apparatuses incorporating photo-interrupters that operate in cooperation with key shutters arranged for keys and that are attached to sensor cases fixed to keybeds (or key frames), for example. In this case, sensor cases are used to determine positions of holding sensors, so that they should be subjected to specific positioning accurately in correspondence with arrangements of keys. Therefore, in an assembling operation of a piano, it takes a relatively long time for work to set appropriate positioning with respect to a sensor case.

Silencing structures can be additionally arranged for the existing upright pianos thereafter. In this case, it is required for workers to arrange silencing structures in consideration of designs and specifications of pianos respectively; therefore, it may take a relatively long time for work to arrange sensor cases appropriately in the existing pianos.

Other types of keyboard instruments such as electronic keyboard instruments having electronic sound sources also use key depression detection apparatuses incorporating sensors that operate in cooperation of keys and that are attached to sensor cases. In this case, it is required for workers to set specific positioning with respect to sensor cases accurately in correspondence with arrangements of keys. In an assembling operation of such an electronic keyboard instrument, it takes a relatively long time for work to set specific positioning with respect to the sensor case.

SUMMARY OF THE INVENTION

It is an object of the invention to provide a key depression detection apparatus for a keyboard instrument in which a sensor case for use in a silencing structure can be simply subjected to accurate positioning in conformity with an arrangement of keys.

A key depression detection apparatus of this invention is constituted by a sensor case incorporating key sensors, which can be easily adjusted in positions relative to an arrangement of keys on a keyboard frame (or a keybed) in a keyboard instrument such as a piano. Specifically, the sensor case (realizing silencing functions) has a case body incorporating a key sensor and is affixed to a base member, which is fixed to a frame end or a key frame of the keyboard frame, by using a fixing member. The fixing member is constituted by a lower member that is elongated to be longer than legs of a case body in the longitudinal direction of a key, and a pair of upper members that are arranged on both ends of the lower member. Therefore, legs of the case body are securely held by the fixing member between the lower member and the upper members, which are connected together using screws accompanied with springs. Thus, an operator (e.g., a worker) can establish accurate positioning of the sensor case relative to an arrangement of keys and can easily adjust the height and inclination of the sensor case by manually controlling screw regulating distances between the lower member and upper members.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

Figure 1:
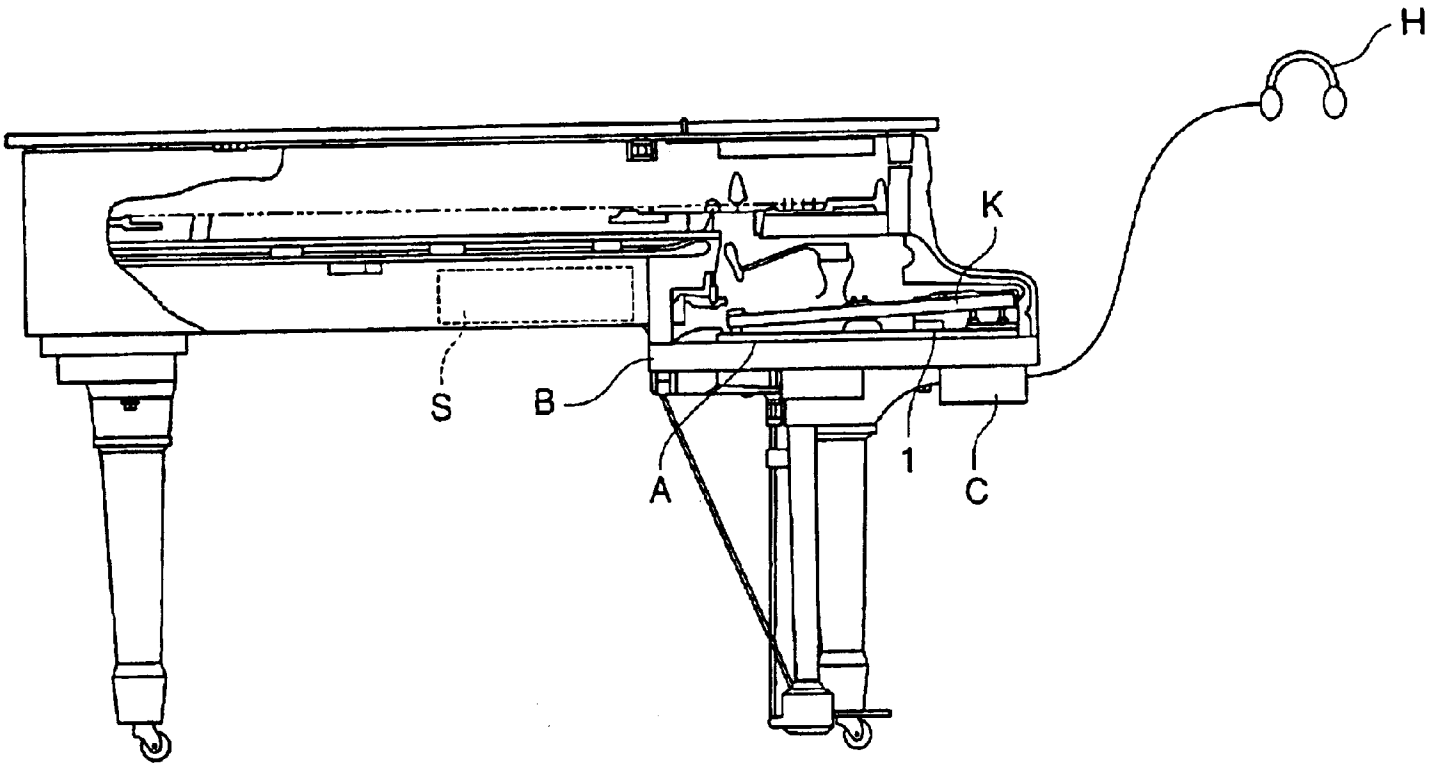
FIG. 1 is a side view partly in cross section showing a grand piano equipped with a key depression detection apparatus in accordance with a preferred embodiment of the invention.

FIG. 1 is a side view partly in cross section showing a grand piano equipped with a key depression detection apparatus in accordance with the preferred embodiment of the invention. Herein, a key depression detection apparatus 1 is arranged on a keyboard frame A on a keybed B of the grand piano and is specifically arranged between keys K and the keyboard frame A. In a grand piano of this example, all the keys K are arranged above and are supported by the keyboard frame A. The key depression detection apparatus 1 generates musical tone signals, which are sent to an electronic sound source S in which they are processed and are then supplied to a controller C. An operator (e.g., a user or a player) is able to listen to musical tones, which are produced by sound producing devices such as a headphone set H connected with the controller C. In addition, the operator is able to adequately adjust or select tone volumes and tone colors by manipulating the controller C.

Figure 2:
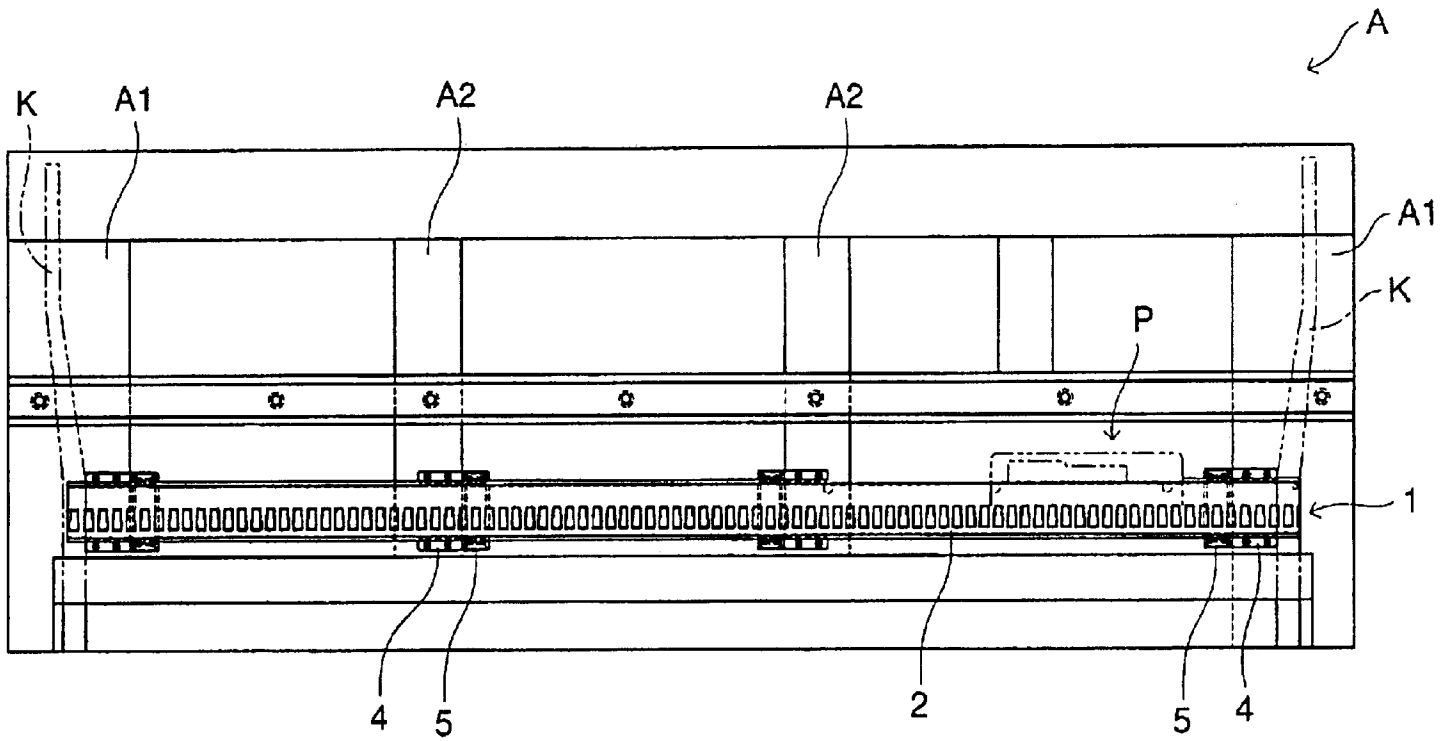
FIG. 2 is a plan view showing a part of the key depression detection apparatus arranged on a keyboard frame of the grand piano shown in FIG. 1.
Figure 3A:
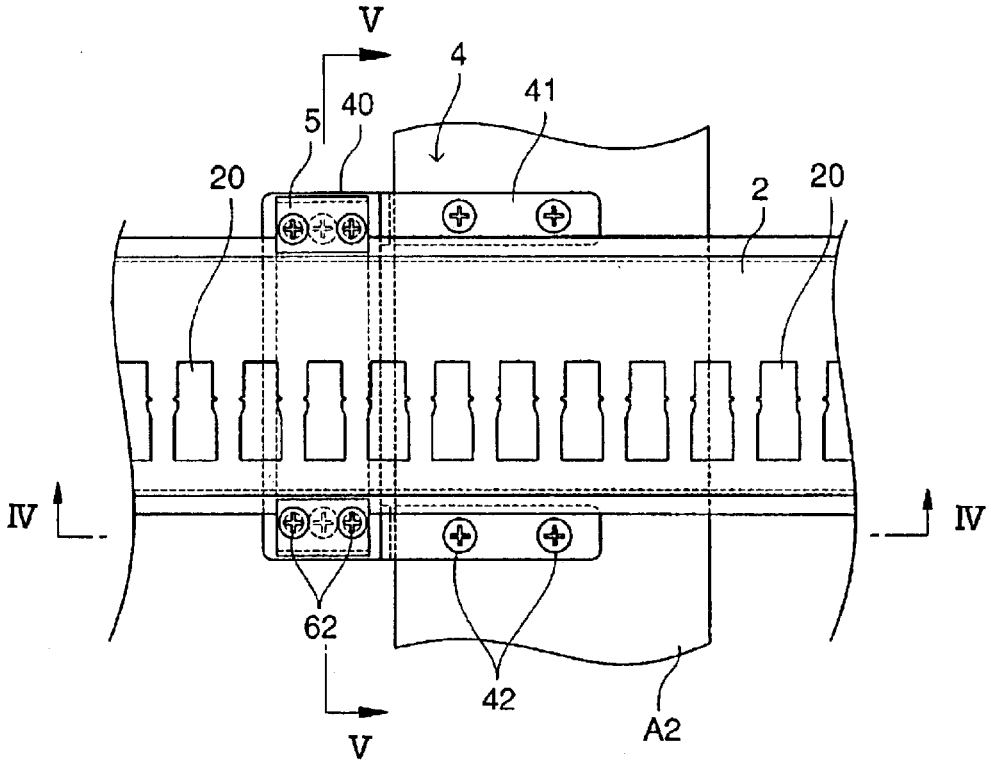
FIG. 3A is an enlarged view showing essential parts of the key depression detection apparatus shown in FIG. 2.
Figure 3B:
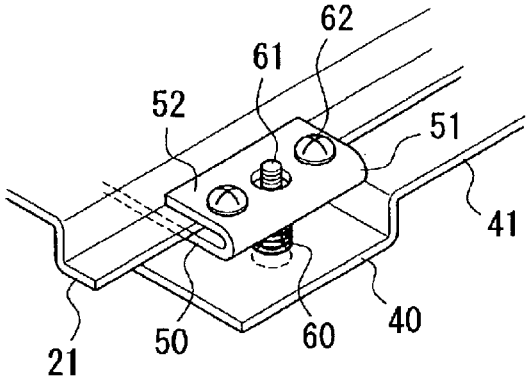
FIG. 3B is a perspective view showing essential parts of a fixing member that securely holds a leg of a sensor case.
Figure 4:
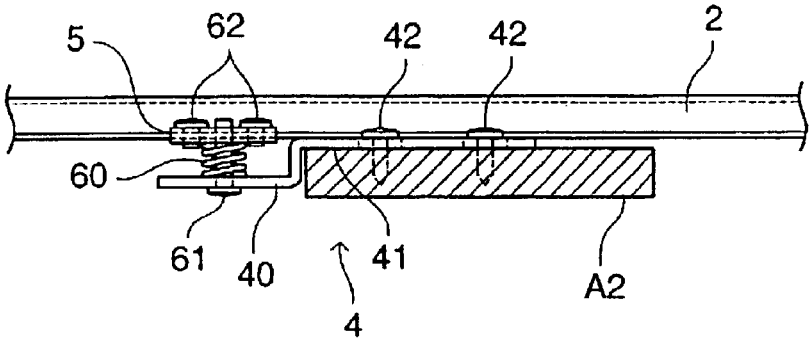
FIG. 4 is a cross sectional view taken along line IV—IV in FIG. 3A.

FIG. 2 is a plan view partly in cross section showing prescribed parts of the grand piano of FIG. 1 in which the key depression detection apparatus 1 is interconnected with the keys 1 on the keyboard frame A. Herein, a sensor case 2 is arranged on the keyboard frame 1 and is elongated in a key arrangement direction. The sensor case 2 has holes 20 for incorporating key sensors therein at prescribed positions in correspondence with an arrangement of the keys K. Key sensors 3 are installed in the holes 20 of the sensor case 2 (see FIG. 5). The keyboard frame A has three elongated members (namely, a back rail, a balance rail, and a front rail), both ends of which are respectively interconnected with frame ends A1, and intermediate portions of which are interconnected with key frames A2. Base members 4 are attached to the frame ends A1 and the key frames A2 respectively. FIG. 3A is an enlarged view showing essential parts of the sensor case 2 and its peripheral members in which a base member 4 is attached to the key frame A2. The base member 4 has roughly a U shape (which is laid on its side) and is constituted by a support portion 40 and a pair of fixing portions 41. That is, the base member 4 is attached to the key frame A2 in such a way that the support portion 40 is arranged along the longitudinal direction of the key K, and the fixing portions 41 rectangularly extending from both ends of the support portion 40 are extended over the upper surface of the key frame A2. As shown in FIGS. 3 and 4, the fixing portions 41 are fixed to the upper surface of the key frame A2 via small screws (or vises) 42. In the present embodiment, the support portion 40 is lowered in elevation as compared with the fixing portions 41, wherein the support portion 40 and the fixing portions 41 are integrally interconnected together via vertical portions. By lowering the support member 40 as shown in FIG. 4, it is possible to lower the position for arranging the sensor case 2, which can be easily arranged between the keys K and the keyboard frame A. The base member 4 is not necessarily constituted by the support member 40 and the fixing members 41 shown in FIGS. 3 and 4. Hence, it is possible to employ other structures for the base member 4, which is required to hold and support prescribed fixing members on the keyboard frame A. Incidentally, the aforementioned base member 4 is also arranged on each of the frame ends A1.

In FIG. 4, the sensor case 2 is fixed in position by using fixing members 5, each of which is attached onto the support portion 40 of the base member 4. The sensor case 2 has a case body (corresponding to the aforementioned hole 20), which holds a key sensor 3 therein and which has a pair of legs 21 that are extended in the longitudinal direction of the key K. Specifically, the sensor case 2 has a prescribed number of openings that are formed in correspondence with key shutters, which are arranged below keys respectively, wherein a distance between adjacent openings is substantially equal to a distance between adjacent keys. Therefore, key shutters can be easily installed in openings of the sensor case 2 accurately in conformity with keys that are arranged to adjoin together via prescribed distances therebetween. That is, it is possible to install key sensors 3 in the sensor case 2 with accurate positioning, which can be simply realized by the aforementioned structure.

Figure 5:
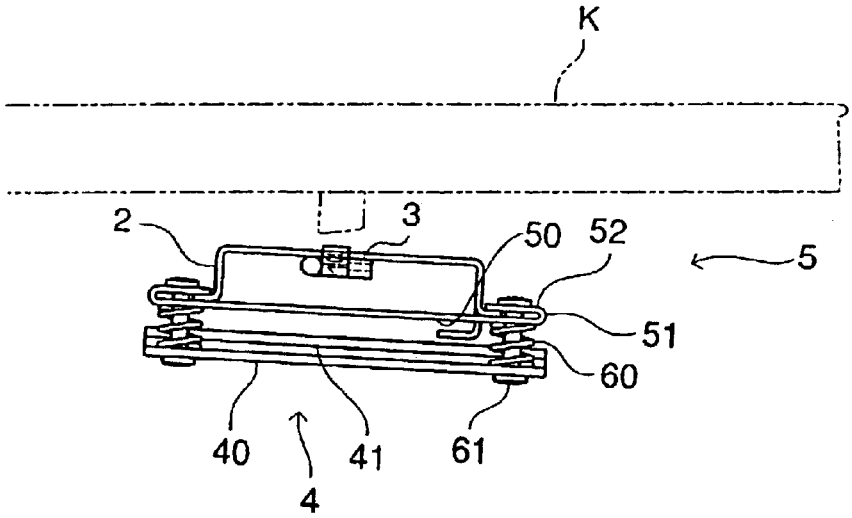
FIG. 5 is a cross sectional view taken along line V—V in FIG. 3A.

As shown in FIG. 5, each of the fixing member 5 is formed in a folded shape in which both ends of a lower member 50 are folded back to form upper members 52 interconnected thereto via folded portions 51, wherein the lower member 50 is elongated in the longitudinal direction of the key K to be longer than the legs 21 of the case body 20, and the upper members 52 are arranged substantially in parallel with the lower member 50. Hence, the legs 21 of the case body 20 are tightly held between the lower member 50 and the upper members 52 respectively.

The fixing member 5 (see FIG. 4) is fixed to the support portion 40 of the base member 4 via a small screw (or a vis) 61 about which a compression coil spring 60 is wound. Hence, as shown in FIG. 5, the support portion 40 of the base member 4 and the fixing member 5 are fixed together via the compression coil springs 60 wound about the small screws 61, wherein through holes are formed at prescribed positions to penetrate through the support portion 40 and the upper members 52 respectively, and tapped holes engaging with the small screws 61 are correspondingly formed at prescribed positions of the lower member 50. Therefore, the fixing member 5 can be moved close to the support portion 40 of the base member 4 by fastening the small screws 61 against spring forces of the compression coil springs 60. Alternatively, the fixing member 5 can be moved to depart from the support portion 40 of the base member 4 by reversely loosening the small screws 61. That is, it is possible to adequately adjust the height and/or inclination of the sensor case 2 by manually operating the fixing members 5.

Figure 6:
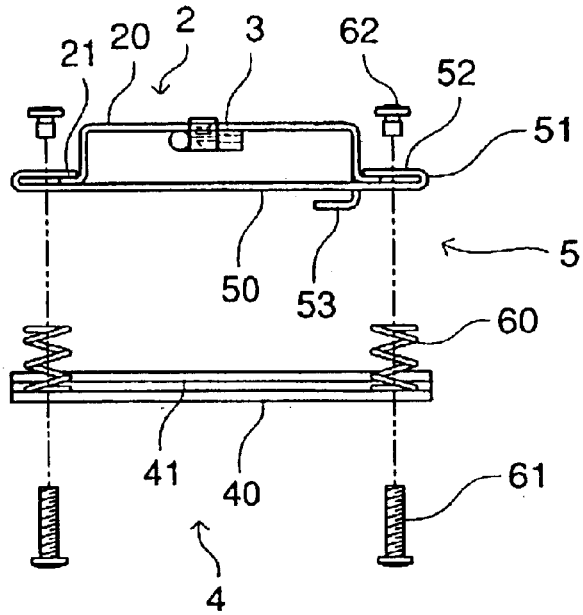
FIG. 6 is an exploded view showing prescribed parts of a fixing member for fixing a sensor case on the keyboard frame.

The legs 21 of the case body 20 are inserted between the lower member 50 and the upper members 52 respectively and are tightly held therebetween by the small screws 62. For this reason, through holes for roughly holding the small screws 62 therein are formed at prescribed positions of the upper members 52, and tapped holes engaged with the small screws 62 are correspondingly formed at prescribed positions of the lower member 50. Thus, it is possible to adequately adjust the position of the sensor case 2 in a key arrangement direction by loosening the small screws 62. Distances between the key sensors 3 that are installed in the case body 20 are directly determined by the prescribed distances of the aforementioned openings of the sensor case 2. Therefore, even when the sensor case 2 is moved in the key arrangement direction by loosening the small screws 62 of the fixing members 5, it is possible to safely move all the key sensors 3 together with the sensor case 2 in the key arrangement direction while maintaining the prescribed distances between the key sensors 3. That is, it is possible to finely adjust the positions of the key sensors 3 accurately in correspondence with an arrangement of the keys. Incidentally, a hook 53 (see FIG. 6) is arranged on the backside of the lower surface 50 in order to allow installation of a printed circuit board P.

Next, a description will be given with respect to details of operations for installing the key depression detection apparatus 1 in a grand piano. First, the base members 4 are respectively attached to the frame ends A1 and the key frames A2 of the keyboard frame A in the grand piano. The key sensors 3 are installed in the case body 20 of the sensor case 2, which is equipped with the fixing members 5 in such a way that the legs 21 of the case body 20 are respectively held between the lower members 50 and the upper members 52. The fixing members 5 are fixed onto the support portion 40 of the base member 4 by using small screws 61 via the springs 60. At this time, small screws 61 engaged with the fixing members 5 are tightened or loosened to adequately adjust the height and inclination of the sensor case 2. This operation can be performed in such a way that a keyboard assembly on the keybed B is pulled forwards to allow manual operations conducted on the small screws 61 thereunder with reference to the key shutters while operating black keys of a keyboard. In this state, the small screws 61 are not firmly tightened so that the sensor case 2 can be freely moved relative to the fixing members 5 in the key arrangement direction. Therefore, it is possible to accurately adjust the position of the sensor case 2 in the key arrangement direction. Then, the small screws 61 are tightened to firmly fix the sensor case 2 in a prescribed position. As described above, the present embodiment allows the key depression detection apparatus 1 to be easily and accurately fixed onto the keyboard frame A.

Figure 7:
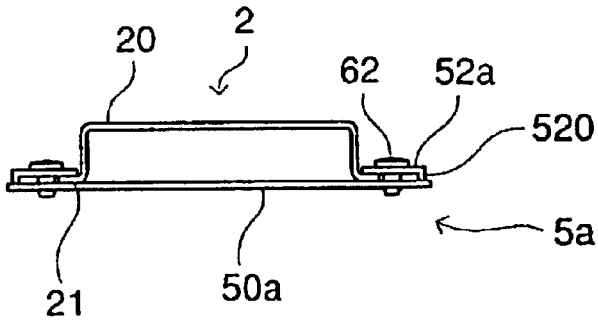
FIG. 7 is a side view showing an example of a structure for fixing a sensor case using a fixing member.

FIG. 7 shows another example of the structure for fixing a case body 20 using a fixing member 5*a* in a key depression detection apparatus, wherein the fixing member 5*a* is constituted by a lower member 50*a* and upper members 52*a*, which are physically separated from each other. Specifically, one end of each upper member 52*a* is arranged to depress the corresponding leg 21 of the case body 20 downwards, while the other end is slightly increased in thickness to suite the thickness of the leg 21. Hence, even when the small screw 62 is tightened while engaging with the upper member 52*a* and lower member 50*a* of the fixing member 5*a*, it is possible to maintain some degree of levelness with respect to the upper member 52*a*. Such a "thick" portion is not necessarily provided in the upper member 52*a* and can be provided in the lower member 50*a*. Alternatively, it is possible to introduce a spacer that is provided independently of the lower member 50*a* and the upper member 52*a*. The fixing member 5*a* is basically constituted similar to the foregoing fixing member 5 except the aforementioned structure. That is, the case body 20 is mounted on the base member 4 that is attached onto the lower member 50*a* of the fixing member 5*a*; then, the upper members 52*a* are arranged on the legs 21 of the case body 20 and are fixed together with both ends of the lower member 50*a* using the small screws 62 while tightly holding the legs 21 therebetween. Thus, it is possible to firmly fix the sensor case 2 by using the fixing members 5*a* via the base members 4 on the keyboard frame.

Figure 8:
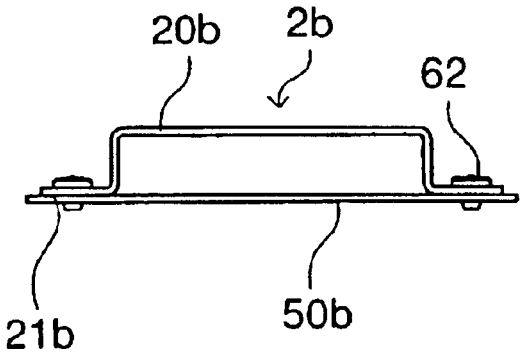
FIG. 8 is a side view showing an example of a structure for fixing a sensor case using a fixing member.
Figure 9:
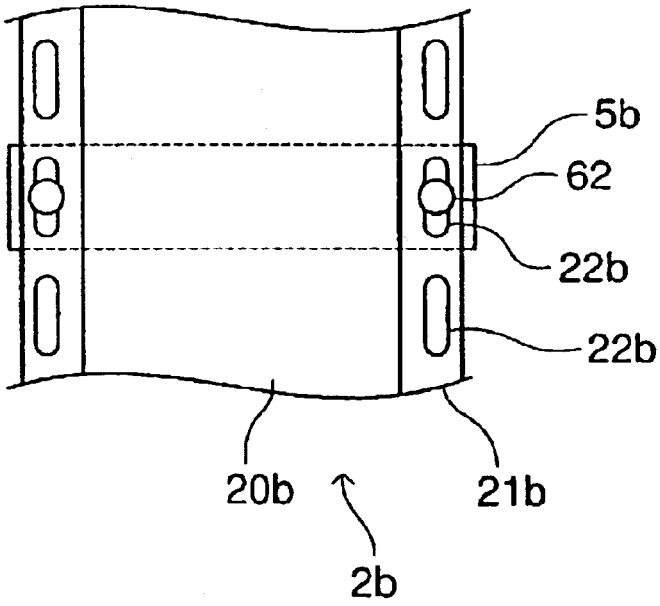
FIG. 9 is a plan view of the structure shown in FIG. 8.

Next, a description will be given with respect to a further example of the structure for fixing a sensor case 2*b* (i.e., a case body 20*b* having legs 21*b*) in a key depression detection apparatus with reference to FIGS. 8 and 9. This example is characterized by using fixing members 5*b*, each of which is constituted using a lower member 50*b* only. Herein, elongated holes 22*b* are periodically formed with prescribed intervals therebetween on both ends of the sensor case 2*b*. Specifically, the case body 20*b* is mounted on the fixing member 5*b* that is attached onto the base member 4, wherein the case body 20*b* is adequately adjusted in position in a key arrangement direction by using the elongated holes 22*b*; thereafter, the case body 20*b* is fixed in position by tightening small screws 62, which are engaged with the legs 21*b* of the case body 20*b*, the lower member 50*b* of the fixing member 5*b*, and the elongated holes 22*b* in turn. By adequately setting desired positions for the elongated holes 22*b* or by arranging a desired number of elongated holes 22*b* along both ends of the sensor case 2*b*, it is possible to realize installation of sensor cases with various types of keyboard frames having different dimensions.

Because grand pianos are actually manufactured by various manufactures, or different models of grand pianos are actually manufactured by each manufacture, there are provided various types of key frames which differ from each other in shapes and dimensions particularly in plan views. The key depression detection apparatus of the present embodiment has a great degree of generality or freedom in installation with numerous types of keyboard instruments such as pianos because the position of the sensor case can be freely adjusted in the height direction of the base member(s) and in the key arrangement direction respectively. Thus, the present embodiment brings a broad range of applications in installation with keyboard instruments such as pianos.

The aforementioned descriptions are given particularly in the case of a grand piano in which a key depression detection apparatus of the present embodiment is installed. Of course, the present embodiment can be easily applied to other types of keyboard instruments such as upright pianos and electronic keyboard instruments. In the case of an upright piano whose keybed is constituted by an upper board, a lower board, and intermediate beams or supports, there is a limitation in arrangement of fixing members together with a sensor case. However, the present embodiment can realize easy installation of a key depression detection apparatus in an upright piano with accurate positioning because it has an ability to be accurately position in the key arrangement direction. Even in other types of upright pianos and electronic keyboard instruments that have other types of keybed structures, the present embodiment allows operators (or workers) to conduct positional adjustment of the sensor case in key arrangement directions after attaching base members to keyboard frames, for example. That is, the present embodiment allows operators to perform assembling operations and positional adjustments separately. As a result, operators can perform assembling operations rapidly.

As described heretofore, this invention has a variety of effects and technical features, which will be described below.

(1) A sensor case has a case body incorporating key sensors in correspondence with an arrangement of keys in a keyboard instrument (e.g., a piano), wherein the sensor case is interconnected with a keyboard frame by using fixing members via base members in such a way that it can be freely adjusted in positioning in a key arrangement direction. In assembly, an operator (e.g., a user or a worker) firstly fixes base members to a keyboard frame (or a key frame); then, fixing members are connected with the keyboard frame via base members, so that a sensor case is affixed to the keyboard frame using fixing members. After interconnecting the sensor case with the keyboard frame, an operator (e.g., a user or a worker) can easily conduct positional adjustment of the sensor case in a key arrangement direction.

(2) That is, this invention allows an operator to conduct fine adjustment of the sensor case after completing assembling operation of the keyboard instrument together with a key depression detection apparatus. Therefore, an operator can easily perform accurate positioning of the sensor case. When installing a silencing structure in the existing keyboard instrument, an operator can easily perform accurate positioning of a sensor case having the aforementioned interconnecting structure that secures positional adjustment of the sensor case in conformity with the design and specification of the existing keyboard instrument.

(3) The sensor case has a case body incorporating key sensors in conformity with a prescribed number of keys arranged in a keyboard of a piano, wherein the case body has legs interconnected with a fixing member, by which an operator (e.g., a worker) can manually adjust the position of the sensor case relative to an arrangement of keys.

(4) Specifically, fixing members are each constituted by a lower member that is longer than lengths of the legs of the case body in the longitudinal direction of a key, and a pair of upper members that are arranged on both ends of the lower member, wherein the legs of the case body are merely held between the lower member and the upper members, which are connected together using screws accompanied with springs. Hence, it is possible for the operator to easily adjust distances between the lower member and the upper members, thus adjusting the height and inclination of the sensor case relative to an arrangement of keys.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A key depression detection apparatus comprising:

a plurality of key sensors that are arranged in conformity with a plurality of keys;

a sensor holder for holding the plurality of key sensors for detecting depressions of the keys respectively, wherein the sensor holder is arranged above a keyboard frame and below the plurality of keys and is elongated along an arrangement of the keys;

a plurality of base members that are fixed to the keyboard frame at prescribed positions respectively; and a plurality of fixing members for fixing the sensor holder to the keyboard frame via the base members in such a way that the sensor holder can be adjusted in position along the arrangement of the keys.

2. A key depression detection apparatus according to claim 1, wherein the sensor holder corresponds to a sensor case having a case body incorporating a key sensor for detecting depression of a corresponding key.

3. A key depression detection apparatus according to claim 2, wherein the case body has legs that are extended in a longitudinal direction of the key and that are securely held by the corresponding fixing member in such a way that the sensor case can be adjusted in height and/or inclination relative to the arrangement of the keys.

4. A key depression detection apparatus according to claim 3, wherein the fixing member is constituted by a lower member that is elongated to be longer than the legs of the case body in the longitudinal direction of the key, and a pair of upper members that are arranged on both ends of the lower member, so that the legs of the case body are securely held between the lower member and the upper members respectively.

5. A key depression detection apparatus according to claim 4, wherein the fixing member is accompanied with a pair of screws by which the lower member and the upper members are interconnected together with desired distances therebetween.

6. A key depression detection apparatus according to claim 4, wherein the fixing member is accompanied with a pair of screws having springs by which the lower member and the upper members are interconnected together, and distances therebetween are controlled.

7. A depression detection apparatus according to claim 1, wherein the sensor holder is movable together with the plurality of key sensors over the keyboard frame.

* * * * *